US010126042B2

(12) United States Patent
Cetinyol et al.

(10) Patent No.: US 10,126,042 B2
(45) Date of Patent: Nov. 13, 2018

(54) COOLING DEVICE COMPRISING A SUPPORT BASE AND A SUPPORT RAIL

(71) Applicant: BSH HAUSGERAETE GMBH, Munich (DE)

(72) Inventors: Dogukan Cetinyol, Istanbul (TR); Bilal Cinici, Tekirdag (TR); Emre Emek, Istanbul (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/500,976

(22) PCT Filed: Jul. 31, 2015

(86) PCT No.: PCT/EP2015/067628
§ 371 (c)(1),
(2) Date: Feb. 1, 2017

(87) PCT Pub. No.: WO2016/016416
PCT Pub. Date: Feb. 4, 2016

(65) Prior Publication Data

US 2017/0219272 A1 Aug. 3, 2017

(30) Foreign Application Priority Data

Aug. 1, 2014 (TR) ..... 2014/08995

(51) Int. Cl.
*F25D 23/06* (2006.01)
*F25D 25/02* (2006.01)
*A47B 96/02* (2006.01)

(52) U.S. Cl.
CPC ..... *F25D 23/06* (2013.01); *A47B 96/02* (2013.01); *F25D 25/02* (2013.01)

(58) Field of Classification Search
CPC ..... A47B 96/02; F25D 23/06; F25D 25/02
USPC ..... 312/401, 405.1, 408, 321.5, 406
See application file for complete search history.

(56) References Cited

U.S. PATENT DOCUMENTS

| | | | | |
|---|---|---|---|---|
| 4,174,486 | A * | 11/1979 | Winkler | A47B 57/567 108/152 |
| 5,692,817 | A | 12/1997 | Jun et al. | |
| 7,669,945 | B2 | 3/2010 | Blersch et al. | |
| 2005/0217301 | A1* | 10/2005 | Iguchi | F25D 19/02 62/302 |
| 2009/0302726 | A1* | 12/2009 | Eckartsberg | A47B 57/425 312/312 |
| 2010/0031694 | A1 | 2/2010 | Benz et al. | |
| 2013/0160483 | A1 | 6/2013 | Hastuerk et al. | |

FOREIGN PATENT DOCUMENTS

| | | |
|---|---|---|
| DE | 202004017125 U1 | 3/2006 |
| JP | 2002195742 A | 7/2002 |

* cited by examiner

*Primary Examiner* — James O Hansen
(74) *Attorney, Agent, or Firm* — Laurence A. Greenberg; Werner H. Stemer; Ralph E. Locher

(57) ABSTRACT

A cooling device includes an inner container having a plurality of walls defining the inner container. A support rail has an opening at one side thereof for supporting a support base inside the inner container. At least two of the walls each have an edge extending inside the support rail through the opening of the support rail and being disposed inside the support rail, providing a connection of the walls to each other.

13 Claims, 4 Drawing Sheets

COOLING DEVICE COMPRISING A SUPPORT BASE AND A SUPPORT RAIL

BACKGROUND OF THE INVENTION

1. Field of the Invention

The invention is related to a cooling device having an inner container and a support rail for a support base. The invention especially related to a household refrigerator with a support shelf fixed on the inner container of the refrigerator by a support rail.

2. Description of Related Art

A cooling device has an inner container to dispose an item to be cooled. The inner container comprises one or more walls to define the inner container. The walls, especially metal walls, are obtained separately as sheets and then connected to each other. The connection of the walls is usually achieved by direct connection like welding or adhering.

The inner container comprises one or more support bases to locate more than one item in the inner container. The support base is removably secured to a wall of the inner container. For this purpose, one or more walls of the inner container comprise a support rail to secure the support base on different locations on the wall.

The support rail is fixed between an inner liner and the wall of an inner container or in front of the wall of the inner container. If it is between the inner liner and the wall, an opening is formed on the wall to access to the support rail from inside of the inner container. If it is in front of the wall of the inner container, the support rail is directly accessible. A support arm of the support base is secured on the support rail by penetrating through the opening on the support rail.

US2010031694 discloses a refrigerating device having a container including a plurality of blanks forming a plurality of walls, a cooled goods support base, and a support rail such that the height of the cooled goods support is adjustably settable. A joint is formed between a blank forming the first side wall and a blank forming the rear wall, and the joint is at least partly concealed behind the support rail.

The invention provides an additional improvement, an additional advantage or an alternative to the prior art.

BRIEF SUMMARY OF THE INVENTION

The purpose of the invention is providing a cooling device assembled in easy and strong manner.

The invention, to achieve the abovementioned purpose, is a cooling device having an inner container comprising a plurality of walls defining the inner container; a support rail having an opening at one side thereof for supporting a support base inside the inner container; and that each of at least two of the walls comprises an edge extending inside the support rail through the opening of the support rail and disposed inside the support rail providing connection of the walls to each other. Thus, there is no need to connect the edges of the walls directly all along the edges, for instance by welding, clinching or adhering.

The cooling device mentioned may be any device that provides a cool environment for an item located in it compared to the outer environment around the device. The cooling device may be a refrigerator and/or a freezer.

The walls of inner container may be made of any material known in the field as a wall material for a cooling device, like painted or unpainted composite, plastic and/or metal. For example, it may be painted aluminum or stainless steel.

The support rail may be a profile and comprise an inner space accessible through the opening. The opening may extend all along the support rail or extend partially.

The support base may be any face (flat or not) carrying an item to be cooled. For instance, it may be a shelf of a refrigerator. The shelf may be a plate (plastic, glass etc.) carried by support arms fixed to the support rail.

In a possible embodiment of the invention, the support rail is disposed between the walls of the inner container and an outer wall of the cooling device. Thus, there may be no need to have an additional inner liner behind the walls of the inner container or no need to extend at least one of the walls of the inner container as covering behind the support rail, which increases production costs. There may be also no need to perform additional effort to fix the support rail on the inner liner or on the at least one of the inner container.

In a possible embodiment of the invention, the support rail is disposed inside foaming applied between the walls of the inner container and an outer wall of the cooling device. Thus, the walls of the inner container may be connected by the support rail and fixed by the pressure of the foaming without any need to an additional inner liner etc. and fixing elements like screw, adhesive etc.

In a possible embodiment of the invention, the edges of the walls are configured such that a support arm of the support base penetrates inside the support rail through the opening. Thus, the usage of the support rail for fixing the support base cannot be prevented or interrupted. Meanwhile, it is possible to make a user see only one line on the wall of the inner container, instead of two separate lines as one for connecting walls and one for fixing the support base on the inner container.

In a possible embodiment of the invention, the edge is configured as folded toward inside the support rail, for example as folded at least twice. For example, the edge may have an L-shape and/or Z-shape cross section inside the support rail. Thus, the edge can hold the support rail like a hook along its length. That makes the connection between the support rail and the wall strong. Furthermore, folding process is relatively an easy process to form a plate, for instance a metal plate. Additionally, having two edges of two walls with L-shape and/or Z-shape cross section facing opposite directions makes the opening clear for penetration of the support arm of the support rail. On the other hand, having such folding make it harder to penetrate for the foaming around the support rail. The foaming should penetrate more than one folds having clearings with very small dimensions, and that is close to impossible. Thus, the problem of foaming leakage during production is prevented. That brings production cost and time reduction.

In a possible embodiment of the invention, the support rail comprises a housing inside for the edge. Thus, a strong connection between the support rail and the wall can be achieved. Moreover, by locating the edge in the housing, the opening is kept open for the penetration of the support arm of the support base.

In a possible embodiment of the invention, the housing is configured as accommodating an end section of the edge. The housing may be a channel formed on an inner face of the support rail. Thus, it is achieved that the opening is clear for penetration of the support arm of the support rail. Moreover, the first folded part of the edge, in other words the leg of L-shape other than the leg with free end or leg of Z-shape other than the leg with free end and the intermediate leg, covers an inner wall of the opening of the support rail visible to the user. Thus, for instance, metal view of the wall continues and the user feels every part as metal, although the support rail is other than metal. As a summary, the user sees a unique wall in terms of material of the wall, although there is a slot line on the wall for the support arm of the support base.

In a possible embodiment of the invention, the support rail comprises locations thereon at which the support base can be adjustably secured to the support rail such that the height of the support base within the inner container is adjustably settable. Thus, the cooling device has a flexibility of usage of inner volume.

In a possible embodiment of the invention, the support rail comprises a strip inside having locations thereon at which the support base can be adjustably secured to the support rail such that the height of the support base within the inner container is adjustably settable. Thus, the necessary durability may be achieved by using a durable strip, although the support rail itself is not durable enough. For example, a metal strip may be employed in a plastic support rail.

In a possible embodiment of the invention, the support rail may comprise a strip slot inside for the strip. Thus, strip can be disposed in the support rail easily, for example it may be slide in the strip slot from an open end of the support rail.

In a possible embodiment of the invention, a front wall of the support rail is wider than the wide of the rest of the support rail. By this way, pressure on the support rail and/or the wall of the inner container caused by weight of the item on the support base and/or weight of the support base itself is kept under control to prevent deformation on the wall of the inner container. It also causes to use only optimum amount of material to obtain the support rail having essential properties. Moreover, the wider front wall provides that foaming inside a wall of the cooling device can exert pressure on the front wall of the support rail towards the wall of the inner container and secures the position of the support rail.

In a possible embodiment of the invention, the rest of the support rail may comprise some part being narrower than the other part of the support rail. Thus, optimum amount of material is used to obtain the support rail. For instance, the part of the support rail having the housing and/or the strip slot may be narrower than the front wall. Additionally, the part of the support rail providing a space behind the strip may be narrower than the part of the support rail having the housing and the strip slot.

In a possible embodiment of the invention, the walls comprise a connection section directly connects the walls to each other above and/or below the support rail. Thus, on the areas, where there is no need to use a support rail, the connection of the walls may be realized.

DETAILED DESCRIPTION OF THE INVENTION

Figure 1:
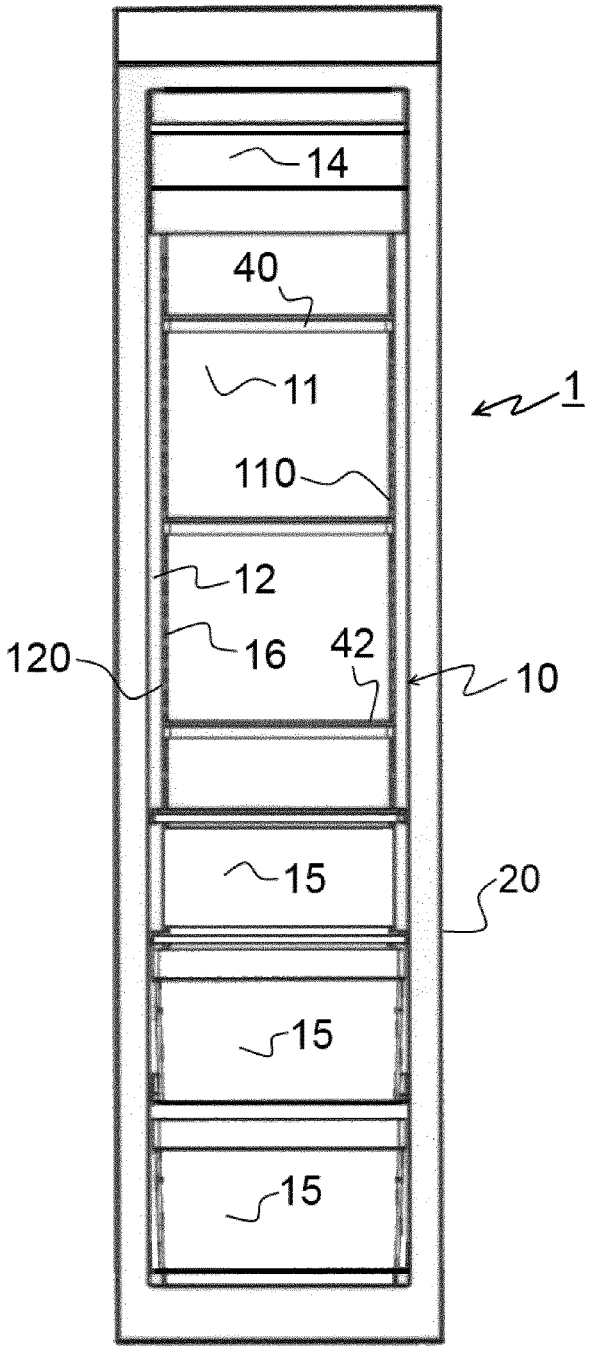
FIG. 1 shows an example to front view of a cooling device for the invention. The cooling device has a door, not shown in the figure.

All directional references such as front, top or bottom are based on reference to the cooling device (1) shown in FIG. 1, in which the visible side is the "front" side of the cooling device (1). One or more of possible embodiments of the present invention will be described as examples in detail below.

The invention is a cooling device (1). FIG. 1 is presents front view of a possible cooling device (1) that is a household refrigerator. The door of the refrigerator is not illustrated in the figure. Therefore, the inner container (10) is seen from front. The inner container (10) is made of three metal sheets; one of which forms back wall (11) and the others forms the side walls (12).

The upper section of the inner container (10) comprises an evaporator cover (14). The lower section of the inner container (10) comprises three drawers (15) for produce and/or meat/fish and other items to be cooled. Between the evaporator cover (14) and the upper drawer (15), the inner container (10) comprises three support bases (40), for example shelves. At right and left sides of the back wall (11) of the inner container (10), there exist slot lines (16) to access support rails (30). The support base (40) is secured to the inner container (10) by the help of the support rail (30).

The support base (40) in the figures has metal support arms (41) and a plate (42) made of glass to carry an item to be cooled.

Figure 2:
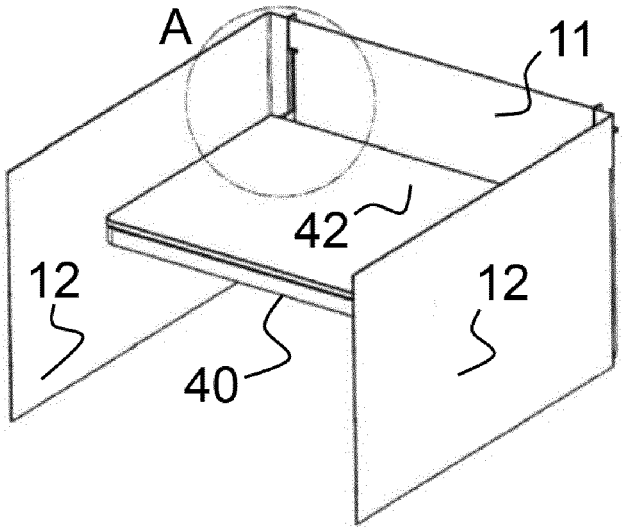
FIG. 2 shows perspective view of walls of the inner container partially, and a support base connected with the support rail.

FIG. 2 shows a perspective view from front-left of the cooling device (1). The figure illustrates only walls (11, 12) of the inner container (10) partially and one support base (40), that is the one closest to the evaporator cover (14).

Figure 3:
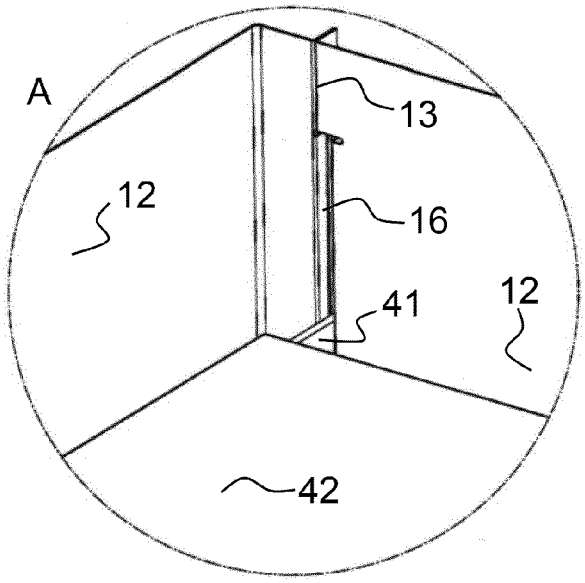
FIG. 3 shows Detail-A obtained from FIG. 2 presenting the opening of the support rail and penetration of the support arm of the support rail.

FIG. 3 presents Detail-A obtained from FIG. 2. It represents left side wall (12) and back wall (11) of the inner container (10). The side wall (12) and back wall (11) are connected to each other. Some part of the connection is achieved by welding a connection section (13) of the walls (11, 12). Below the connection section (13), the slot line (16), through which the support arm (41) of the support rail (30) passes through, is presented.

Figure 4:
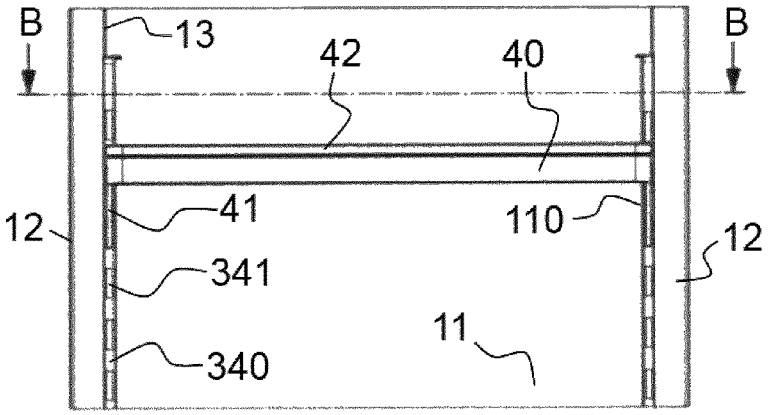
FIG. 4 shows partial front view of the inner container as shown in FIG. 2.

FIG. 4 illustrates front view of the elements in the FIG. 2. The side walls (12) and back wall (11) of the inner container (10), the slot line (16) and the support base (40) can be seen in FIG. 4. In the figure, apertures (341) for hanging the support base (40) are provided on the support rail (30). The apertures (341) can be seen on FIG. 4. The apertures (341) are formed vertically spaced manner. Thus, the support base (40) can be fixed adjustably in vertical direction. FIG. 4 also clearly shows that the user sees only one line on the back wall (11) as a connection line of the side walls (12) and back wall (11).

Figure 5:
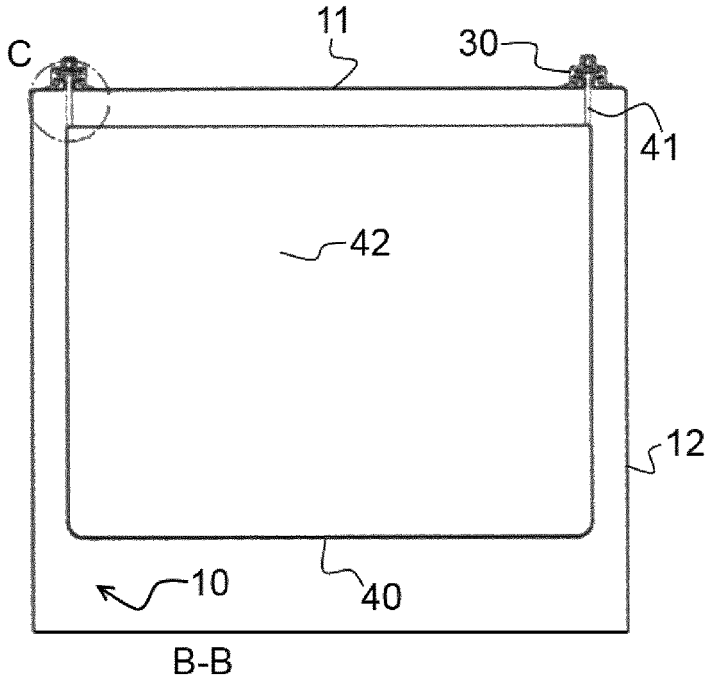
FIG. 5 shows the cross-sectional view of B-B obtained from FIG. 4.

FIG. 5 is a cross sectional view of B-B from top of the cooling device (1). The section is obtained from FIG. 4. The FIG. 5 comprises sectional view of the support rail (30) and the walls (11, 12) of the inner container (10). It also presents top view of the support base (40).

Figure 6:
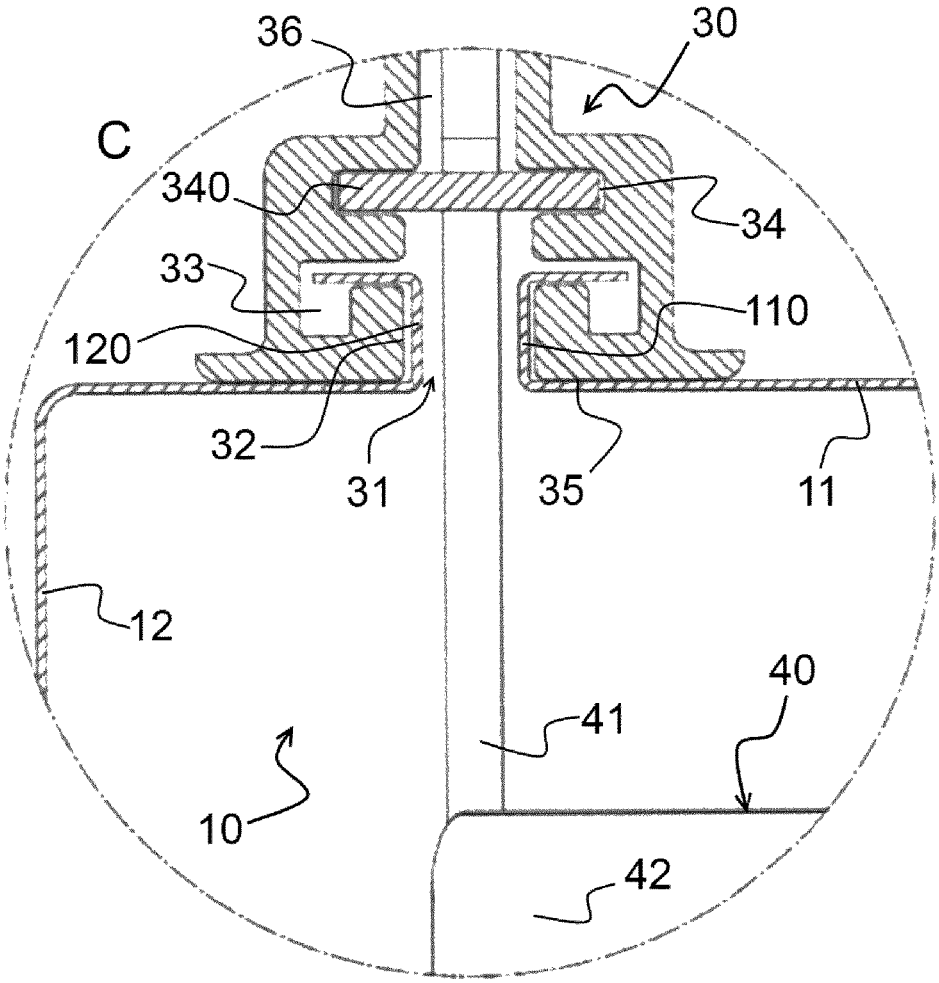
FIG. 6 shows Detail-C obtained from FIG. 5 presenting cross-section of walls and the support rail and position of the support arm of the support rail.

FIG. 6 illustrates the Detail-C gathered from FIG. 5. The figure shows details of the support rail (30) and the side wall (12) and the back wall (11).

The support rail (30) comprises a single body. The body may be metal or plastic based. The slot line (16) is presented in the middle of the front face of the support rail (30) and lies along the support rail (30). The support rail (30) is symmetrical with respect to the plane lying along the slot line (16).

In each of the symmetrical half, the support rail (30) comprises a housing (33) as a channel on an inner face (32) of the support rail (30) facing an inner face (32) of the other symmetrical half.

The housing (33) has a cross section of L-shape, one leg of L is parallel to and the other leg of L is perpendicular to the wall (11, 12) of the inner container (10). The perpendicular leg extends toward the wall (11, 12). In another alternative, the perpendicular leg may extend away from the wall (11, 12). According to that, the edges (110, 120) of the walls (11, 12) are folded inside the support rail (30) through the opening (31) and then folded again toward inside the housing (33). It provides that the edge (110, 120) has an L-shape cross section inside the support rail (30). For the second alternative of the housing (33), the edge (110, 120) may have a Z-shape cross section inside the support rail (30). That is similar to L-shape but it has also a third leg being about perpendicular to the wall (11, 12) and extending away from the wall (11, 12). This part of the edges (110, 120) acts like a hook and grabs the support rail (30). By this way, the walls (11, 12) are connected to each other by the help of the support rail (30).

Similar to the channel providing housing (33), the support rail (30) also has a strip slot (34) on the same inner face (32) of each half of the support rail (30). However, the strip slot (34) has only a linear channel to accommodate a linear strip (340). The strip (340) comprises the apertures (341) mentioned above.

The support rail (30) has space (36) behind the strip (340) for the end of the support arm (41) passing through the apertures (341).

The front wall (35) of the support rail (30) is wider than the wide of the rest of the support rail (30). For that, the support rail (30) comprises an extending wall at each half of it as extending away from the support rail (30) in parallel to the wall (11, 12) of the inner container (10).

The part of the support rail (30) having the housing (33) and the strip slot (34) is narrower than the front wall (35). Additionally, the part of the support rail (30) providing the space (36) behind the strip (340) is narrower than the part of the support rail (30) having the housing (33) and the strip slot (34).

The edges of the opening (31) of the support rail (30) comprises rounded edges. Thus the wall (11, 12) of the inner container (10) folded inside the support rail (30) is also has rounded edges. By that, the edges of the opening (31) will be harmless to the user or the parts of the cooling device (1).

The support rail (30) is connected with the walls (11, 12) of the inner container (10) as such that the edges (110, 120) of the walls (11, 12) are prepared as folded and then the support rail (30) pushed over the edges (110, 120). The edges (110, 120) bend toward each other and enters the housing (33) corresponding to each.

REFERENCE NUMBERS

1. Cooling device
10. Inner container
11. Back wall
110. Edge
12. Side wall
120. Edge
13. Connection section
14. Evaporator cover
15. Drawer
16. Slot line
20. Outer wall
30. Support rail
31. Opening
32. Inner face
33. Housing
34. Strip slot
340. Strip
341. Aperture
35. Front wall
36. Space
40. Support base
41. Support arm
42. Plate

The invention claimed is:

1. A cooling device, comprising:

an inner container having a plurality of walls defining said inner container;

a support base;

a support rail having one side with an opening formed therein for supporting said support base inside said inner container; and at least two of said walls each having an edge extending inside said support rail through said opening formed in said support rail, said edges being disposed inside said support rail for interconnecting said walls; and wherein said support rail has an inner face and an inner housing accommodating said edges, where said housing is a channel formed in said inner face.

2. The cooling device according to claim 1, which further comprises an outer wall of the cooling device, said support rail being disposed between said walls of said inner container and said outer wall of the cooling device.

3. The cooling device according to claim 1, which further comprises:

an outer wall of the cooling device; and foaming applied between said walls of said inner container and said outer wall of the cooling device;

said support rail being disposed inside said foaming.

4. The cooling device according to claim 1, wherein said support base has a support arm, and said edges of said walls are configured to permit said support arm to penetrate inside said support rail through said opening.

5. The cooling device according to claim 1, wherein said edges are folded toward an inside of said support rail.

6. The cooling device according to claim 5, wherein said edges are folded at least twice toward said inside of said support rail.

7. The cooling device according to claim 1, wherein said edges have respective end sections, and said housing accommodates said end sections.

8. The cooling device according to claim 1, wherein said support rail includes locations on said support rail at which said support base can be adjustably secured to said support rail to permit a height of said support base within said inner container to be adjustably set.

9. The cooling device according to claim 8, wherein said support rail includes a strip inside said support rail having locations thereon at which said support base can be adjustably secured to said support rail to permit said height of said support base within said inner container to be adjustably set.

10. The cooling device according to claim 9, wherein said support rail includes a strip slot inside said support rail for accommodating said strip.

11. The cooling device according to claim 1, wherein said support rail includes a front wall having a width and a remainder having a width, and said width of said front wall is greater than said width of said remainder.

12. The cooling device according to claim 11, wherein said remainder of said support rail includes a part being narrower than another part of said support rail, for optimizing an amount of material used to create said support rail.

13. The cooling device according to claim 1, wherein said walls include a connection section directly connecting said walls to each other at least one of above or below said support rail.

* * * * *